US006786553B1

(12) United States Patent
Grove

(10) Patent No.: US 6,786,553 B1
(45) Date of Patent: Sep. 7, 2004

(54) CHAIR WITH PIVOTABLE BACK

(76) Inventor: James E. Grove, 4316 Marina City Dr., #423CTN, Marina del Rey, CA (US) 90292

( * ) Notice: Subject to any disclaimer, the term of this patent is extended or adjusted under 35 U.S.C. 154(b) by 0 days.

(21) Appl. No.: 10/656,563

(22) Filed: Sep. 4, 2003

(51) Int. Cl.[7] ..... B60N 2/02
(52) U.S. Cl. ..... 297/378.12
(58) Field of Search ..... 297/378.12, 378.1

(56) References Cited

U.S. PATENT DOCUMENTS

| | | | | | |
|---|---|---|---|---|---|
| 3,032,373 | A | * | 5/1962 | Danciart et al. | 297/371 |
| 3,301,597 | A | | 1/1967 | Bereday | |
| 3,669,495 | A | | 6/1972 | Van Rudgisch | |
| 3,784,252 | A | | 1/1974 | Peterson | |
| 4,919,485 | A | | 4/1990 | Guichon | |
| 5,265,939 | A | | 11/1993 | Self et al. | |
| 5,282,664 | A | * | 2/1994 | Tseng | 297/31 |
| 5,288,126 | A | | 2/1994 | Saul et al. | |
| 5,308,146 | A | | 5/1994 | Chou | |
| 5,356,204 | A | | 10/1994 | McDonough | |
| 5,509,720 | A | | 4/1996 | Croom | |
| 5,755,489 | A | | 5/1998 | Rossman et al. | |
| 5,795,028 | A | | 8/1998 | Dussia, Jr. et al. | |
| 6,089,669 | A | | 7/2000 | Wilcox et al. | |
| 6,151,765 | A | | 11/2000 | Asplund | |
| RE37,043 | E | * | 2/2001 | Yamazaki | 297/332 |
| 6,422,654 | B1 | | 7/2002 | Grove | |

* cited by examiner

*Primary Examiner*—Milton Nelson, Jr.
(74) *Attorney, Agent, or Firm*—Jack C. Munro

(57) ABSTRACT

A chair with a chair back pivotally mounted to a pair of armrests which are fixedly secured to a seat. The chair back can be moved from a collapsed position located directly adjacent the seat to an upright position which is substantially transverse to the seat. When in the upright position, a pair of spring biased pins engaged with the chair back in the upright position.

4 Claims, 2 Drawing Sheets

CHAIR WITH PIVOTABLE BACK

BACKGROUND OF THE INVENTION

1. Field of the Invention

The field of this invention relates to furniture and more specifically to a chair where the back of the chair can be pivoted from a collapsed position, for shipping, located directly against the seat of the chair to an upright position, which is the normal position of usage.

2. Description of the Related Art

A typical chair has a seat and a back extending transversely or upright from the seat. This configuration of a chair is not readily adaptable to shipping after being manufactured for the reason that a chair inherently occupies a substantial amount of space. It is common for chairs to be manufactured in overseas manufacturing facilities which means that the chairs are required to be put into cartons and then shipped by shipping containers to the continental United States. The size of the shipping carton for a chair, which contains a back attached to a seat in the normal manner, is of a significant size and therefore limits the number of shipping cartons that can be placed within a shipping container. The shipping of assembled chairs means that the chairs incur a substantially increased shipping cost as opposed to any chair that is shipped in a disassembled state because a much fewer number of assembled chairs are locatable in a shipping container.

In the past, in order to minimize the shipping expense of chairs, it has been common to detach the chair back from the seat. The back can then be placed against the seat with the result that a significantly more compact unit is achieved for purposes of shipping. Once the disassembled chair reaches the retailer, either the retailer or the consumer is required to then assemble the chair. Assembly usually requires several bolt type fasteners to be installed in place and tightened. Many consumers find not only to assemble a chair to be an annoyance, but it also can be rather time consuming and difficult for certain individuals that have a minimal amount of mechanical skill.

It would be desirable to design a chair that did not require any tools for assemblage but yet the chair can assume a collapsed configuration. The retailer or consumer will only need to move the chair back to an upright position at which time the chair back will be locked in conjunction with the seat and the chair is now ready for usage. Such a quick and easy locating of the chair for usage is highly desired.

SUMMARY OF THE INVENTION

One of the primary objectives of the present invention is to construct a chair that is collapsible for purposes of shipping, but upon reaching the selling or consuming destination, the chair can be moved from its collapsed position to a normal usage position without requiring the using of any fasteners or the use of any tools.

The basic embodiment of chair with pivotable back of this invention comprises a seat which is adapted to support the buttocks of a human user. A first armrest is secured to one side edge of the seat and a second armrest is secured to the opposite side edge of the seat. A chair back is to be pivotally mounted in conjunction with both armrests with the chair back to be able to assume a collapsed position located directly against the seat. Upon the chair back being moved from the collapsed position to an upright position, a pin lock assembly interengages between each armrest and the chair back to lock the chair back in position.

A further embodiment of the present invention is where the basic embodiment is modified by there being formed a pair of holes in the chair back.

A further embodiment of the present invention is where the just previous embodiment is modified by there also being included in the chair back cam surfaces that cause the pin lock assemblies to be moved to a retracted position prior to engagement with their respective hole.

A further embodiment of the present invention is where the just previous embodiment is modified by each of the pin lock assemblies being spring biased tending to located the pin lock assemblies in an extended position.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
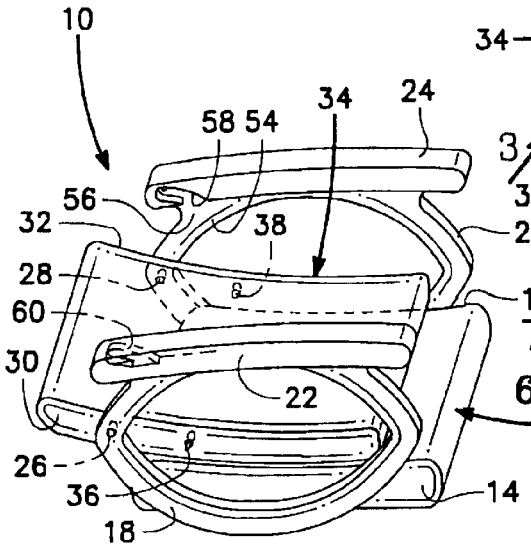
FIG. 1 is an isometric view showing the chair with pivotable back of the present invention in the collapsed position.

Referring particularly to the drawings, there is shown the chair 10 of this invention. The chair 10 includes a substantially planar seat 12. A person's buttocks (not shown) is adapted to be located on the upper surface of the seat 12. The seat 12 has side edges 14 and 16. Fixedly mounted to the side edge 14 is a first armrest 18. A second armrest 20 is fixedly mounted to the side edge 16. Armrest 18 includes a cushioned pad 22. Armrest 20 includes a similar cushioned pad 24. Normally, the cushioned pads 22 and 24 will be constructed of a rigid material covered with a cushioning material made of leather and plastic combined with foam or some other similar cushioning material.

Figure 2:
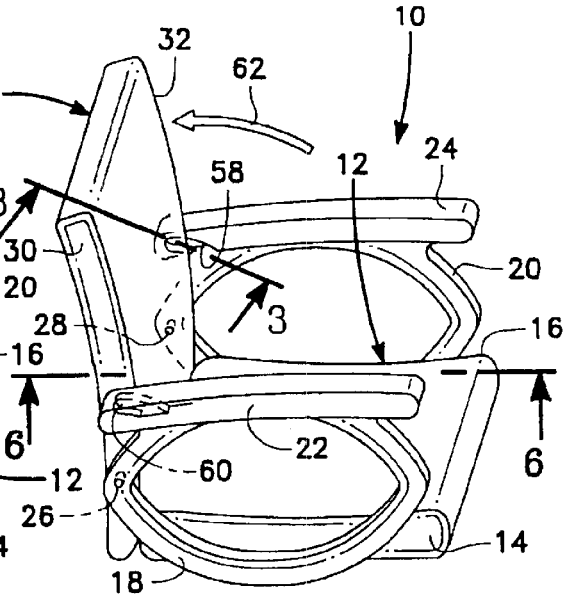
FIG. 2 is an isometric view similar to FIG. 1 but with the chair with pivotable back of this invention in the upright position.

The first armrest 18 includes a sleeve (not shown) with the second armrest 20 including a similar sleeve 29. Pivot pins 26 and 28 are mounted within their respective side edges 30 and 32 of a chair back 34. Pivot pin 26 is to engage within the sleeve (not shown) mounted in side edge 30. Pivot pin 28 is to engage within sleeve 29 mounted in side edge 32. The pivot pins 26 and 28 permit the chair back 34 to pivot between a collapsed position, which is shown in FIG. 1, to an upright position, which is shown in FIG. 2. The upright position in FIG. 2 locates the chair back 34 substantially transverse relative to the seat 12. Generally, the chair back 34 will be constructed of a rigid material upon which is placed a cushioning material and construction of the chair back 34 is deemed to be conventional.

Figure 3:
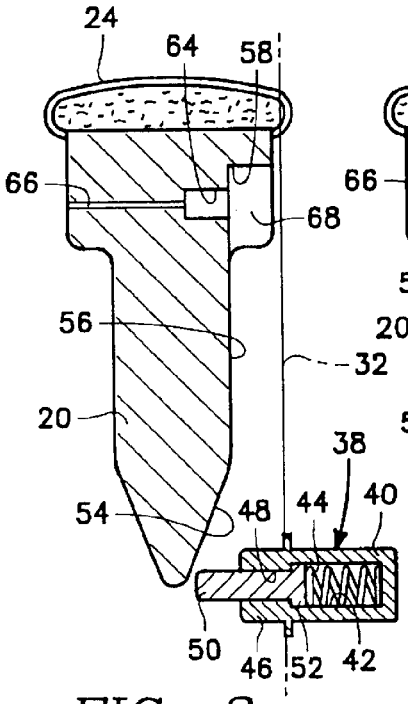
FIG. 3 is a cross-sectional view taken generally along line 3—3 of FIG. 2 which depicts the initial positioning of a pin lock assembly in conjunction with the armrest as the chair back is being moved from the collapsed position to the upright position.

Mounted within the chair back 34 and connecting with the side edge 30 is a pin lock assembly 36. Also mounted within the chair back 34 and connecting with the side edge 32 is a pin lock assembly 38. Each pin lock assembly 36 and 38 is constructed in precisely the same manner. The pin lock assemblies 36 and 38 include a housing 40. Formed within the housing 40 is an internal chamber 42. Mounted within the internal chamber 42 is a coil spring 44. The housing 40 has a front portion 46 which is to extend exteriorly of the side edge 30 and also the side edge 32. The remaining portion of the housing 40 is imbedded within the chair back 34. Formed within the front portion 46 is a through hole 48. Mounted within the through hole 48 is a pin 50. The back end of the pin 50 is enlarged forming a flange 52. The flange 52 is captured within the internal chamber 42 and abuts against the coil spring 44. The pin 50 can be moved relative to the housing 40 between a retracted position, shown in FIG. 4, and an extended position, shown in FIGS. 3 and 5.

Armrest 20 has an inclined cam surface 54. Armrest 20 also includes a flat cam surface 56. Armrest 20 also includes a cam channel 58 which has a wall surface 68. It is to be understood that the armrest 18 will have a similar inclined cam surface 54 and a flat cam surface 56, which is not shown. Armrest 18 also has a cam channel 60 which is located in a facing relationship relative to the cam channel 58. Cam channel 60 also has a wall surface 68. It is to be understood that the cam channel 60 is to connect with pin lock assembly 36 while the cam channel 58 connects with pin lock assembly 38.

Figure 4:
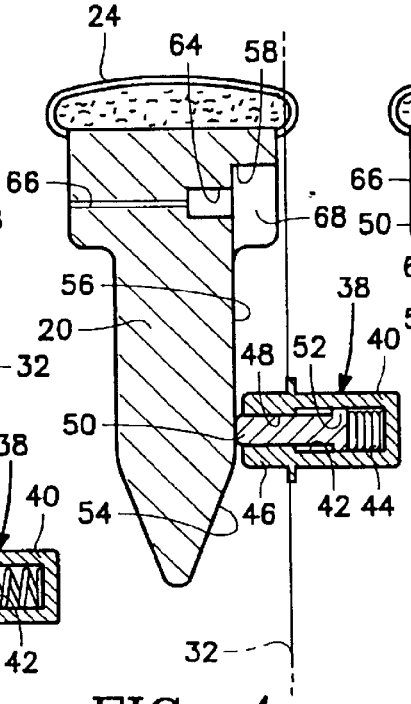
FIG. 4 is a cross-sectional view similar to FIG. 3 showing the pin lock assembly engaged with a cam surface of the armrest as it is being moved toward the upright position.
Figure 5:
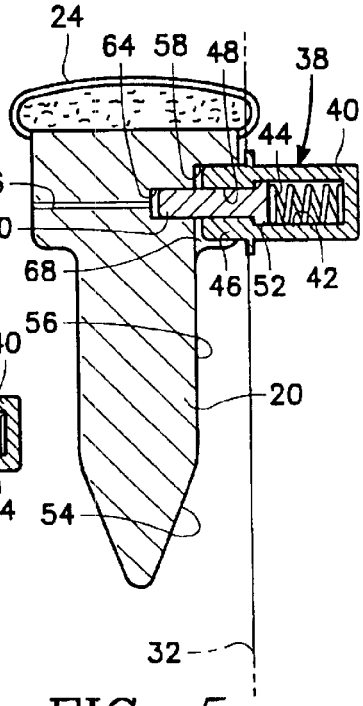
FIG. 5 is a cross-sectional view similar to FIG. 4 showing the position of the pin lock assembly when the chair back is locked in the upright position.
Figure 6:
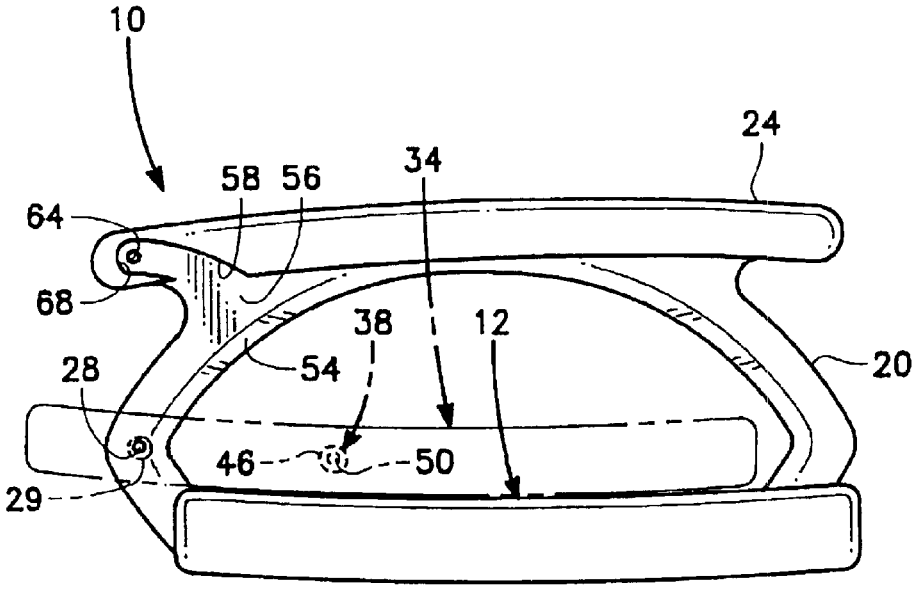
FIG. 6 is a cross-sectional view taken along line 6—6 of FIG. 2 showing the position of the chair back in the collapsed position.
Figure 7:
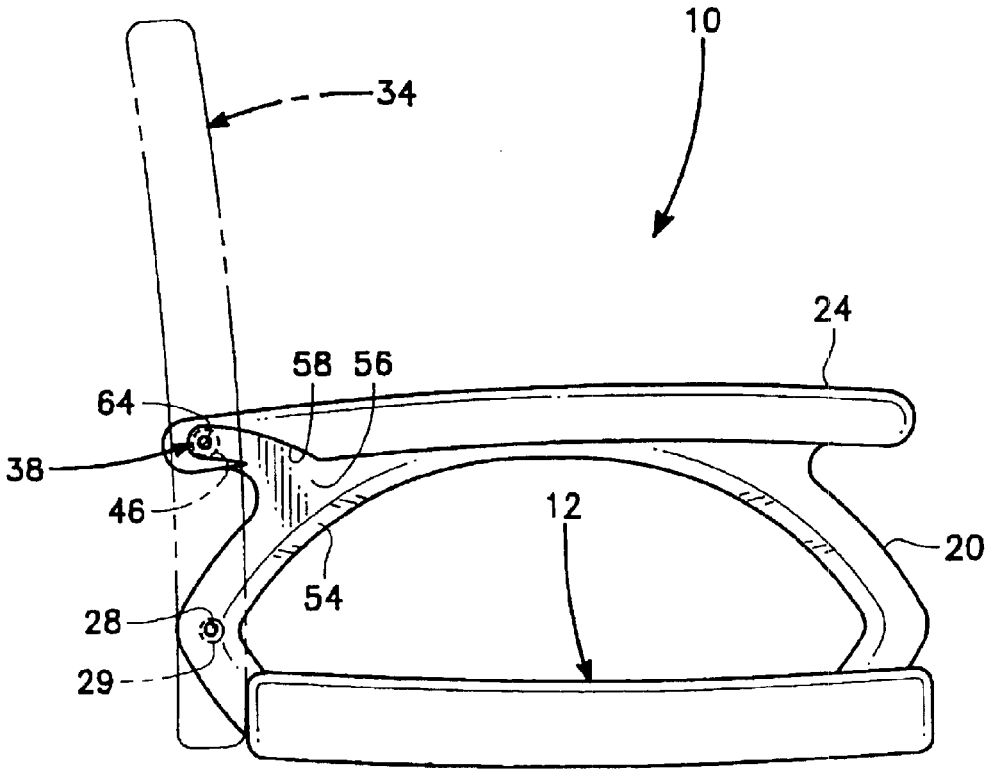
FIG. 7 is a cross-sectional view similar to FIG. 6 but showing the chair back in the upright position.

As the chair back is moved from the collapsed position, shown in FIG. 1 to the upright position shown in FIG. 2, when the chair back 34 has been moved about sixty degrees in the direction of arrow 62, pin 50 will come into contact with inclined cam surface 54. As the chair back 34 continues to move toward the upright position, the pin 50 will slide along the surface of the inclined cam surface 54 causing the pin 50 to move from an extended position to a retracted position, which is shown in FIG. 4. This compresses spring 44. It is to be noted that spring 44 exerts a constant bias tending to locate pin 50 in the extended position. Pin 50 will then continue to ride along the flat cam surface 56 until the front portion of housing 40 comes into contact with cam channel 58. Pin 50 will continue to ride within the surface of cam channel 58 until finally coming into connection with hole 64 formed in armrest 20. At that particular time, pin 50 then will be moved to the extended position. This same type of engagement with hole 64 is also to occur simultaneously in conjunction with armrest 18. The result is that chair back 34 is now fixedly locked in position relative to armrests 18 and 20 and seat 12.

Normally, once chair back 34 is connected in the upright position, as shown in FIG. 2, there will never be a need to have the chair back 34 move again to the collapsed position. The collapsed position is only for the purpose of shipping of chair 10 to the retailer and to be used by the consumer. It can be seen that by pivoting chair back 34 to the upright position, as shown in FIG. 2, there are no tools that are required. However, at some time if it is deemed by the user desirable to have chair back 34 to be again moved to the collapsed position, which would again probably be for the reason of further transportability, there is provided a release hole 66 into which is to be inserted a small elongated tool which is designed to come into contact with pin 50 and permit such to be pushed sufficiently in order to disengage pin 50 from hole 64. If the release hole of both armrests 18 and 20 is utilized, then chair back 34 will be permitted to move back to the collapsed position.

When chair back 34 is in the upright position, it is to be noted that the front portion 46 of each pin lock assembly 36 and 38 will be in tight connection with the wall surface 68 of cam channels 58 and 60. This prevents any further movement of chair back 34 in the direction of arrow 62 so that chair back 34 is maintained in a precisely transverse position relative to seat 12. The sitting force that is incurred from the user is transferred through the front portions 46 through their respective cam channels 58 and 60 and therefore hence to armrests 20 and 18 and then to seat 12.

What is claimed is:

1. A chair with pivotable back comprising:

a seat which is adapted to support buttocks of a human user, said seat having a first side edge and a second side edge;

a first armrest secured to said seat and mounted at said first side edge;

a second armrest secured to said seat and mounted at said second side edge;

a chair back which is adapted to be located against the user's back;

a first pivot pin interconnecting said first armrest and said chair back;

a second pivot pin interconnecting said second armrest and said chair back, whereby said chair back is capable of pivoting relative to said seat between an upright or transverse position relative to said seat and a collapsed position locating said chair back in juxtaposition with said seat; and said first armrest having a first pin lock assembly, said second armrest having a second pin lock assembly, both said first pin lock assembly and said second pin lock assembly securely engaging with said chair back to fix same in place when said chair back is in said upright position.

2. The chair with pivotable back as defined in claim 1 wherein:

said chair back having a first hole and a second hole, said first pin lock assembly engaging with said first hole, said second pin lock assembly engaging with said second hole.

3. The chair with pivotable back as defined in claim 2 wherein:

said chair back including a first cam surface located directly adjacent said first hole, said chair back including a second cam surface located directly adjacent said second hole, whereby during movement of said chair back from said collapsed position to said upright position said first pin lock assembly is depressed to a retracted position by said first cam surface and said second pin lock assembly is moved to a retracted position by said second cam surface and upon said first pin lock assembly and said second pin lock assembly reaching respectively said first hole and said second hole said first pin lock assembly and said second pin lock assembly each move to an extended position.

4. The chair with pivotable back as defined in claim 3 wherein:

said first pin lock and said second pin lock being continuously spring biased toward said extended position.

* * * * *